US009377280B2

(12) United States Patent
Schlenter

(10) Patent No.: US 9,377,280 B2
(45) Date of Patent: Jun. 28, 2016

(54) DETONATOR ROLL CALL

(71) Applicant: DETNET SOUTH AFRICA (PTY) LIMITED, Sandton (ZA)

(72) Inventor: Craig Charles Schlenter, Sandton (ZA)

(73) Assignee: DETNET SOUTH AFRICA (PTY) LIMITED, Sandton (ZA)

( * ) Notice: Subject to any disclaimer, the term of this patent is extended or adjusted under 35 U.S.C. 154(b) by 0 days.

(21) Appl. No.: 14/411,885

(22) PCT Filed: Jul. 1, 2013

(86) PCT No.: PCT/ZA2013/000046
§ 371 (c)(1),
(2) Date: Dec. 29, 2014

(87) PCT Pub. No.: WO2014/008516
PCT Pub. Date: Jan. 9, 2014

(65) Prior Publication Data

US 2015/0159986 A1 Jun. 11, 2015

(30) Foreign Application Priority Data

Jul. 2, 2012 (ZA) ..... 2012/04904

(51) Int. Cl.

| | |
|---|---|
| ***F23Q 21/00*** | (2006.01) |
| ***F42D 1/02*** | (2006.01) |
| ***F42D 1/055*** | (2006.01) |
| ***F42D 1/04*** | (2006.01) |

(52) U.S. Cl.
CPC .. *F42D 1/02* (2013.01); *F42D 1/04* (2013.01); *F42D 1/055* (2013.01)

(58) Field of Classification Search
CPC ..... F42D 1/05
USPC ..... 102/217, 311, 206, 215, 275.11, 202.5
See application file for complete search history.

(56) References Cited

U.S. PATENT DOCUMENTS

| | | | | |
|---|---|---|---|---|
| 3,849,607 | A * | 11/1974 | Carbrey | 379/236 |
| 4,537,131 | A * | 8/1985 | Saunders | 102/217 |
| 6,422,147 | B1 * | 7/2002 | Shann | 102/312 |
| 7,017,494 | B2 | 3/2006 | Kouznetsov | |
| 7,322,293 | B2 | 1/2008 | Kouznetsov | |
| 7,533,613 | B2 | 5/2009 | Kouznetsov | |
| 7,848,078 | B2 * | 12/2010 | Hummel et al. | 361/247 |
| 7,870,825 | B2 | 1/2011 | Teowee | |
| 7,929,270 | B2 * | 4/2011 | Hummel et al. | 361/249 |

(Continued)

FOREIGN PATENT DOCUMENTS

| | | | | |
|---|---|---|---|---|
| EP | 0301848 | | 2/1989 | |
| EP | 301848 | A2 * | 2/1989 | F42D 1/06 |
| WO | WO 2011/032189 | * | 3/2011 | F42D 1/055 |

OTHER PUBLICATIONS

International Search Report and Written Opinion for Application No. PCT/ZA2013/000046 dated Nov. 8, 2013 (9 pages).
International Preliminary Report on Patentability for Application No. PCT/ZA2013/000046 dated Jun. 17, 2014 (21 pages).

*Primary Examiner* — J. Woodow Eldred
(74) *Attorney, Agent, or Firm* — Michael Best & Friedrich LLP

(57) ABSTRACT

A detonator roll call method wherein each detonator is assigned a unique identifier and, at each detonator, in response to an enquiry signal to all the detonators a count is incremented and compared to the roll call identifier and, if the comparison is positive, a reply is sent by the detonator.

18 Claims, 3 Drawing Sheets

(56) References Cited

U.S. PATENT DOCUMENTS 7,971,531 B2 * 7/2011 Teowee et al. ..... 102/217
2001/0040030 A1 * 11/2001 Lerche et al. ..... 166/63
2008/0098921 A1 * 5/2008 Labuschagne et al. .... 102/202.5
2008/0105154 A1 * 5/2008 Kouznetsov ..... 102/215
2010/0288149 A1 * 11/2010 Schlenter ..... 102/217

* cited by examiner

DETONATOR ROLL CALL

CROSS-REFERENCE TO RELATED APPLICATIONS

This patent application is a national stage filing under 35 U.S.C. 371 of International Patent Application No. PCT/ZA2013/000046, filed Jul. 1, 2013, which claims priority to South African Patent Application No. 2012/04904, filed Jul. 2, 2012, each of which is incorporated herein by reference in its entirety.

BACKGROUND OF THE INVENTION

This invention relates to a method of communicating with each of a plurality of detonators in a blasting system.

An important step in carrying out a blasting event is to establish that each detonator which should be included in a blasting system is present and is functional. This can be done, for example, by means of a roll call process wherein an interrogating signal is sent repeatedly from a control device. Each detonator, in turn, responds to the interrogating signal and thereby notifies the control device that the detonator is present. Status information can also be presented to the control device.

U.S. Pat. No. 7,848,078 describes a method for polling a plurality of detonators. Each detonator, in an interconnected array of detonators, is interrogated to reply in a time slot that is associated with a unique anti-collision response time stored in the detonator. The successful implementation of this technique requires that each detonator includes a unique timing device, such as an oscillator, which must be calibrated to ensure that the replies from the various detonators are separated, in time, from one another and do not overlap. The accuracy of an oscillator is, however, dependent on various factors including temperature and, in order to eliminate the effects of oscillator drift, each of the oscillators must be calibrated shortly before the detonators are polled.

Different approaches to the situation are described in U.S. Pat. Nos. 7,533,613 and 7,971,531. The latter case requires a blasting machine to be preloaded with detonator identifiers. Other art in the field includes U.S. Pat. Nos. 7,870,825, 7,322,293, and 7,017,494.

An object of the present invention is to provide a polling technique which does not require oscillator calibration nor pre-loading of identity numbers into a blasting machine, and which avoids "collisions" between signals from responding detonators.

SUMMARY OF THE INVENTION

The invention provides a method of conducting a roll call of a plurality of detonators which includes the steps of:

1. providing a respective roll call counter for each detonator;
2. assigning to each detonator a respective roll call identifier which is unique to the detonator;
3. transmitting a start signal to all of the detonators;
4. at each detonator, in response to reception of the start signal, setting the respective roll call counter to a respective first specific value;
5. polling the detonators by transmitting an enquiry signal to all the detonators; and
6. at each detonator:
   a) in response to reception of the enquiry signal, changing the respective first specific value in the roll call counter to a respective second specific value;
   b) comparing the respective second specific value to the respective roll call identifier for the detonator; and
   c) if, at least, the comparison in step b) is positive, causing the detonator to transmit a respective reply signal.

Step 5 may be repeated, i.e. enquiry signals are sequentially transmitted, until each detonator in the plurality of detonators has been afforded an opportunity of transmitting a respective reply signal.

The start signal may be associated with one or more parameters which may specify at least one requirement which must be met in order for a detonator to transmit a respective reply signal. By way of example, a parameter associated with the start signal may require a detonator to be successfully armed before a reply signal can be transmitted by the detonator (in step 6(c)).

The first specific value to which the roll call counter, in each detonator, is set may vary according to requirement. For example, the roll call counter may be set to zero or to another particular value. The latter possibility allows polling to start with a particular roll call identifier i.e. detonator.

The enquiry signal may be of any appropriate kind. Preferably the enquiry signal is of short duration so that the roll call method of the invention is implemented quickly. For example, if the detonators are connected to a wire harness or bus then a reversal of polarity of a voltage applied to the detonators e.g. a reversal of a voltage on one or more conductors in the bus may take place. This, according to a defined protocol, may be interpreted by a detonator as an enquiry signal which requires the transmission of a reply signal, provided appropriate conditions are satisfied.

In each detonator the respective second specific value to which the roll call counter is changed may take place by incrementing or decrementing the first specific value (or count) in the roll call counter, or by modifying in some other suitable and predictable way the first specific value in the roll call counter.

It is possible for a detonator, upon receiving an enquiry signal, to be required to satisfy at least one predetermined condition before transmitting a respective reply signal. For example, the comparison in step 6(b) may be required to be positive and, additionally, it may be a prerequisite that the detonator must be armed.

The nature of the reply signal may vary according to requirement. The reply signal may constitute a modulation pulse on the harness or wire bus. Alternatively, the reply signal may contain detailed information, about the detonator selected, for example, from the detonator's identity, its status, and a check sum, or other verifying information, or the like.

After a reply signal has been transmitted by a detonator a time interval of a predetermined duration may elapse before a subsequent enquiry signal is transmitted. Thus the enquiry signals may be transmitted at regularly spaced time intervals.

The start signal and the enquiry signals may be transmitted from a control device. Each reply signal may be directed to the control device. The control device may be a blasting machine.

The invention has been described with reference to the use of a wire bus or harness. This is not limiting for the control device may be connected in a wireless manner to the plurality of detonators.

The roll call method may be interrupted or terminated using any appropriate technique. For example, after a given enquiry signal, a time interval during which no signals are transmitted, may be lengthened to a period which is unambiguously detectable by the detonators, despite the detonators not including calibrated timing means, such as oscillators.

Another possibility is to transmit, in place of an enquiry signal, a distinct control signal which stops or interrupts the roll call method.

The roll call method can be implemented in respect of all of the detonators in a blasting system or in respect of one or more subsets thereof. The latter aspect may for example be controlled, as has been indicated, by transmitting a start signal which contains information, or a command, which determines the first specific value to which each detonator is set in step 4. This first specific value may identify a starting detonator in a desired subset of detonators.

BRIEF DESCRIPTION OF THE DRAWINGS

The invention is further described by way of example with reference to the accompanying drawings in which.

DESCRIPTION OF PREFERRED EMBODIMENTS

Figure 1:
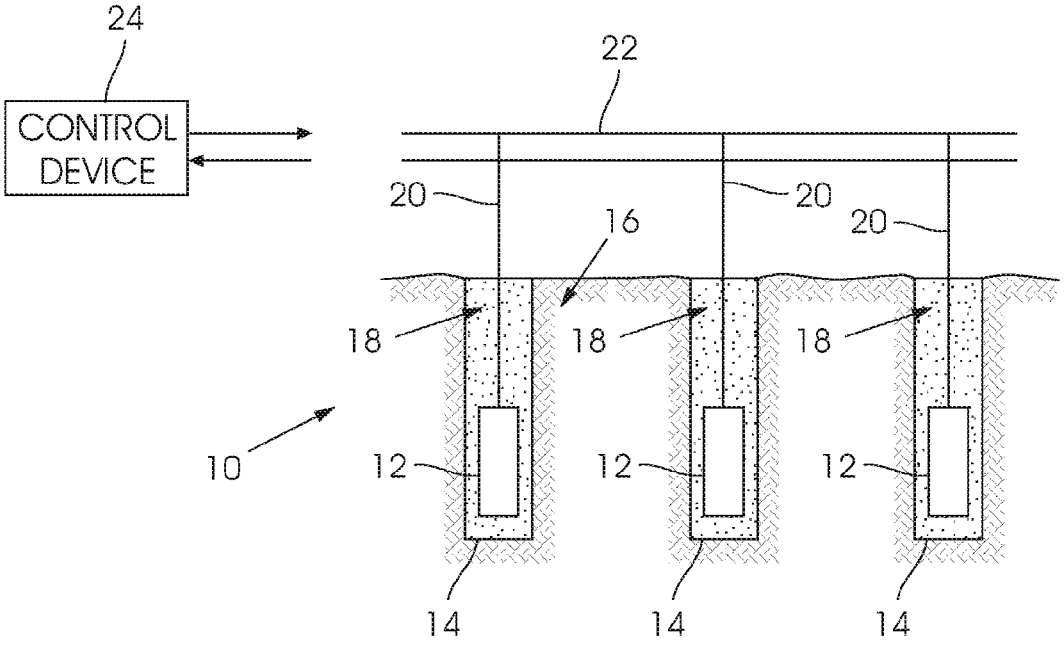
FIG. 1 illustrates a blasting system in which the roll call method of the invention is implemented.

FIG. 1 of the accompanying drawings schematically illustrates a part of a blasting system 10 in which the roll call method of the invention is implemented. The blasting system includes a plurality of detonators 12 each of which is located in a respective borehole 14 formed in a rock 16 which is to be blasted. Each borehole contains explosives 18. The detonators are connected by leads 20 and a harness or wire bus 22 to a control device 24 which, typically, is a blasting machine.

In broad terms the aforementioned aspects are conventional. It is to be noted, however, that although the invention is described with reference to the use of a harness or wire bus 22 to connect the control device 24 to each of the detonators, this is exemplary only for any other suitable technique may be employed. For example, the control device 24 may communicate in a wireless manner with the detonators. Another possibility is to communicate with the detonators using optical, or magnetic induction, processes.

Figure 2:
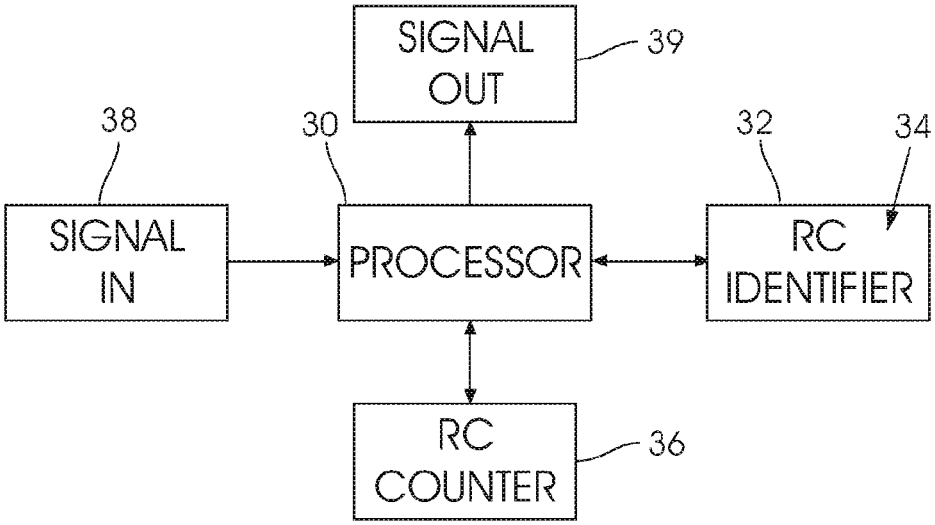
FIG. 2 illustrates circuit aspects embodied in each detonator included in the blasting system of FIG. 1.

FIG. 2 illustrates certain circuit components which are included in each detonator. Additional components which are included in each detonator to enable the detonator to achieve its functionality are not shown. These additional components are known in the art. Each detonator includes, at least, a processor 30, a memory section 32 in which a roll call identifier 34 is stored, a roll call counter 36, a receiver component 38 for receiving an input signal, and a transmitter component 39 for transmitting an output signal. Typically an input signal received by the component 38 is originated at the control device 24 shown in FIG. 1, while an output signal transmitted from the component 39 is directed to the control device. As noted, in the FIG. 1 example, the input and output signals are conducted via the harness or wire bus. In a different example of the invention the signals would be transmitted wirelessly, or optically through an acceptable medium.

As a prerequisite to the firing of the blasting system shown in FIG. 1, it is desirable to be able to interrogate the system to establish that each specified detonator is, in fact, present, and to ascertain the status of each detonator. A polling process of this type can take a significant time. The method of the invention is concerned inter alia with implementing this type of polling technique rapidly and efficiently.

Each detonator 12 in the system is assigned a unique roll call identifier 34 which is stored in the respective memory section 32. The identifiers for the respective detonators are preferably allocated sequentially. This may occur as the detonators are tagged or tested, or as they are being placed in the respective boreholes 14. Other options do, however, exist. For example, in a daisy chain configuration the detonators may be numbered in the order in which they are enumerated in the daisy chain. The roll call identifier of each detonator may be distinct from any other identifier or code associated with the detonator. The roll call identifier may, in fact, constitute the only communication-based identifier for the detonator.

Figure 3A:
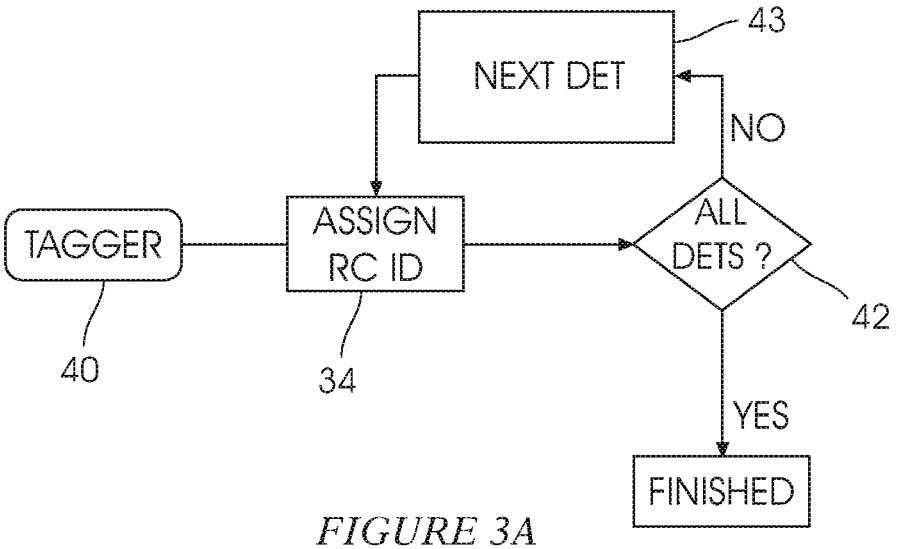
FIGS. 3A, 3B and 3C are respective flow charts which illustrate various steps in different phases during the implementation of the method of the invention.

A flow chart in FIG. 3A represents the use of a tagger 40 which assigns a roll call identifier 34 to a detonator at the time the detonator is connected to the harness 22. The tagger is used sequentially (steps 42, 43) with all of the detonators. Use of the tagger is discontinued once each detonator has been assigned a respective unique roll call identifier.

Figure 3B:
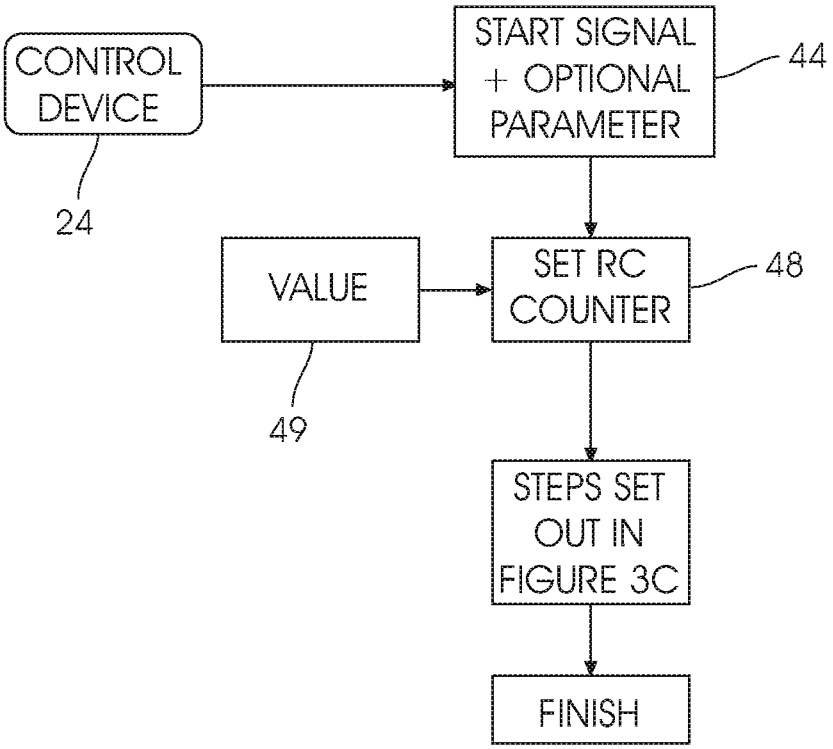

Referring to a flow chart in FIG. 3B, and to FIG. 1, when a roll call or polling process is to be implemented the control device 24 is operated to generate a command 44 which is transmitted to all of the detonators. The command contains a start signal which may embody only one unique element, e.g. a code which identifies the command as a start signal. However, one or more optional parameters or additional information may be associated with the start signal, contained in the command. For example, a parameter may be attached to the start signal to specify that a particular status must prevail at a target detonator to enable the detonator to respond to the start signal. For example, it may be a prerequisite that a detonator must be fully armed in order for the detonator to be able to respond to the start signal.

At each detonator the start signal is received by the respective receiver component 38 and, in response thereto, the roll call counter 36, of that detonator, is set (step 48) to a respective first specific value. This value may be zero or any other desired value. A reference e.g. a particular value 49 may be stored in the roll call counter to indicate that the roll call is to be implemented only for a particular subset, or series, of detonators in the system, as opposed to starting with the first detonator in the system and then continuing through all of the detonators. Alternatively the reference (particular value 49) which is optional, may be attached to the start signal in the command 44.

Figure 3C:
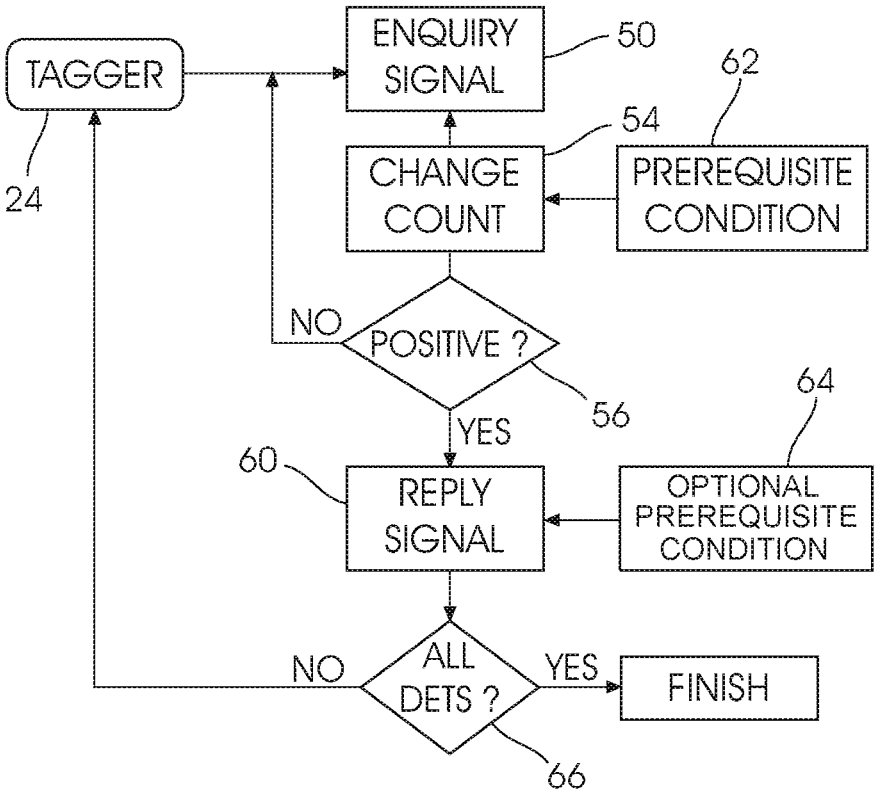

After the start signal has been transmitted to, and has been acted on by, each detonator, the control device 24 polls the detonators by transmitting a plurality of enquiry signals 50 in succession to all of the detonators—refer to the flow chart in FIG. 3C. Each enquiry signal may be modulated on the harness or wire bus. The duration of each enquiry signal should be as short as is possible, so that the polling process can be carried out rapidly. By way of example, a modulated signal may be produced by reversing a polarity of a voltage on one or more conductors of the wire bus. The reversal of polarity, when detected by a detonator, is then interpreted by the detonator as an invitation to reply, provided appropriate conditions at the detonator prevail.

At each detonator, in response to receiving an enquiry signal 50 by the respective component 38, the first specific value 49 stored in the roll call counter 36 is changed (54) to a second specific value. This can be done by incrementing the value (count) in the counter, by decrementing the value, or by manipulating the value in the counter in any appropriate way. Subsequently, in each detonator, the value in the counter 36 is compared (step 56) to the roll call identifier 34 stored in the memory section 32. If the value in the counter 36 is matched to the roll call identifier, or if matching takes place between pre-specified parts thereof, the comparison is taken to be positive and the detonator (step 60) will then transmit a reply signal through the respective signal component 39, to the control device 24.

Optionally, the comparison process checks at least one additionally specified, prerequisite condition (62) before replying. For example, the detonator may only reply if the count value in the counter 36 matches the roll call identifier 34 and if the detonator is armed.

The nature of the reply signal may vary according to requirement. In one example the reply signal simply constitutes a modulation pulse on the bus 22. The reply signal may also contain more detailed information 64 about the detonator such as its identity, status, check sum or the like. Longer replies do, however, slow the overall process and short replies are therefore preferable.

The operation of the control device 24 is subject, at least, to control by a timer which may be a hardware device or which may be implemented using software techniques. Successive enquiry signals are transmitted by the control device at predetermined time intervals in order to poll each detonator in the sequence. The voltage on the bus 22 may be lowered during the reception period of the preceding reply signal and the voltage may again be raised for a predefined time period after reception of the reply signal, before the next enquiry signal is transmitted.

The roll call process is stopped once all the detonators have been polled. However the roll call process can be stopped in any other appropriate way. For example, the control device 24 may be regulated so that it does not produce any modulation on the bus (output signal) for a period which is long enough to be detected unambiguously by the detonators, despite the absence of calibrated times in the detonators. Alternatively, a signal which is distinct from the enquiry signal is transmitted on the bus and, when detected by the detonators, is interpreted as a command to end the roll call process.

The method of the invention thus allows a defined state of each detonator in the system, or of each detonator in a subset of the system, to be queried rapidly and accurately. The requirement for precisely calibrated internal clocks in the detonators is obviated.

The polling method can be adapted so that it can be used with a wireless communication technique e.g. an optical communication method.

The detonators can be polled at any appropriate stage, or time. For example, the method can be used to conduct a fast "presence check" to ensure that all detonators are connected to the bus, or to determine whether each detonator has an acceptable status or an assigned time delay. Other variations are possible to one skilled in the art.

The roll call technique may be modified to enhance any existing command, as desired. For example, a command to arm the detonators could incorporate a signal to start the roll call process. Thus, in response to the arm command, each detonator would reset its respective roll call counter and then await subsequent enquiry signals without the requirement for a distinct roll call start signal from the control device. Each detonator would also then check if the arm command were successful before responding.

The invention claimed is:

1. A method of conducting a roll call of a plurality of detonators (12) which includes the steps of:

1. providing a respective roll call counter (36) for each detonator (12);
2. assigning to each detonator a respective roll call identifier (34) which is unique to the detonator (12);
3. generating a command which contains a start signal (44), and at least one parameter, which specifies a detonator status;
4. transmitting the command (44) to all of the detonators (12);
5. at each detonator (12), in response to reception of the start signal (44), setting the respective roll call counter (36) to a respective first specific value (49);
6. polling the detonators (12) by transmitting an enquiry signal (50), by reversal of a voltage applied or transmitted to the detonators (12), to all the detonators; and
7. at each detonator (12):

a) in response to reception of the enquiry signal (50), changing the respective first specific value (49) in the roll call counter (36) to a respective second specific value (54);

b) comparing (58) the respective second specific value (54) to the respective roll call identifier (34) for the detonator (12); and c) if, at least, the comparison in step b) is positive, and if said detonator status prevails at the detonator (12), causing the detonator to transmit a respective reply signal.

2. A method according to claim 1 wherein, for each detonator (12), the first specific value (49) causes polling to start with a particular detonator (12).

3. A method according to claim 2 which includes the steps of sequentially transmitting a plurality of said enquiry signals (50) until each detonator (12) in the plurality of detonators has been afforded an opportunity of transmitting the respective reply signal.

4. A method according to claim 3 wherein the enquiry signals (50) are transmitted at regularly spaced time intervals.

5. A method according to claim 4 wherein, for each detonator (12) the respective reply signal which is transmitted by said detonator (12) includes information selected from: an identity number for the detonator, the roll call identifier for the detonator, a status signal relating to the detonator, and a check sum for the detonator.

6. A method according to claim 5 which is terminated, after enquiry signal (50), after a time interval, during which no signal is transmitted which is unambiguously detectable by the detonators despite the detonators not including calibrated timing means, or by transmitting a control signal which is distinct from the enquiry signal.

7. A method according to claim 6 which is implemented in respect of a subset of the detonators in said plurality of detonators by including in the start signal (44) the respective first specific value (49) which identifies a starting detonator in the subset.

8. A method according to claim 3 wherein, for each detonator (12) the respective reply signal which is transmitted by said detonator (12) includes information selected from: an identity number for the detonator, the roll call identifier for the detonator, a status signal relating to the detonator, and a check sum for the detonator.

9. A method according to claim 3 which is terminated, after said enquiry signal (50), after a time interval, during which no signal is transmitted which is unambiguously detectable by the detonators despite the detonators not including calibrated timing means, or by transmitting a control signal which is distinct from the enquiry signal.

10. A method according to claim 3 which is implemented in respect of a subset of the detonators in said plurality of detonators by including in the start signal (44) the respective first specific value (49) which identifies a starting detonator in the subset.

11. A method according to claim 2 wherein, for each detonator (12) the respective reply signal which is transmitted by said detonator (12) includes information selected from: an identity number for the detonator, the roll call identifier for the detonator, a status signal relating to the detonator, and a check sum for the detonator.

12. A method according to claim 3 which is terminated, after said enquiry signal (50), after a time interval, during which no signal is transmitted which is unambiguously detectable by the detonators despite the detonators not including calibrated timing means, or by transmitting a control signal which is distinct from the enquiry signal.

13. A method according to claim 4 which is implemented in respect of a subset of the detonators in said plurality of detonators by including in the start signal (44) the respective first specific value (49) which identifies a starting detonator in each subset.

14. A method according to claim 1 which includes the steps of sequentially transmitting a plurality of said enquiry signals (50) until each detonator (12) in the plurality of detonators has been afforded an opportunity of transmitting the respective reply signal.

15. A method according to claim 14 wherein the enquiry signals (50) are transmitted at regularly spaced time intervals.

16. A method according to claim 1 wherein, for each detonator (12) the respective reply signal which is transmitted by said detonator (12) includes information selected from: an identity number for the detonator, the roll call identifier for the detonator, a status signal relating to the detonator, and a check sum for the detonator.

17. A method according to claim 1 which is terminated, after said enquiry signal (50), after a time interval, during which no signal is transmitted which is unambiguously detectable by the detonators despite the detonators not including calibrated timing means, or by transmitting a control signal which is distinct from the enquiry signal.

18. A method according to claim 1 which is implemented in respect of a subset of the detonators in said plurality of detonators by including in the start signal (44) the respective first specific value (49) which identifies a starting detonator in each subset.

* * * * *